US008857363B2

(12) United States Patent
Sahlin

(10) Patent No.: US 8,857,363 B2
(45) Date of Patent: Oct. 14, 2014

(54) HYDROFOIL ARRANGEMENT

(75) Inventor: Alexander Sahlin, Huddinge (SE)

(73) Assignee: Elektrofoil AB, Nacka (SE)

( * ) Notice: Subject to any disclaimer, the term of this patent is extended or adjusted under 35 U.S.C. 154(b) by 88 days.

(21) Appl. No.: 13/516,052

(22) PCT Filed: Dec. 14, 2010

(86) PCT No.: PCT/SE2010/051378
§ 371 (c)(1),
(2), (4) Date: Jun. 14, 2012

(87) PCT Pub. No.: WO2011/075053
PCT Pub. Date: Jun. 23, 2011

(65) Prior Publication Data

US 2012/0255479 A1 Oct. 11, 2012

(30) Foreign Application Priority Data

Dec. 17, 2009 (SE) ..... 0901577

(51) Int. Cl.
*B63B 1/28* (2006.01)

(52) U.S. Cl.
CPC ..... *B63B 1/285* (2013.01)
USPC ..... 114/280; 114/274

(58) Field of Classification Search
USPC ..... 114/274–282
See application file for complete search history.

(56) References Cited

U.S. PATENT DOCUMENTS 3,199,484 A * 8/1965 Wiberg ..... 114/279
3,710,747 A 1/1973 Guidi

FOREIGN PATENT DOCUMENTS

| | | |
|---|---|---|
| EP | 0118737 A2 | 9/1984 |
| GB | 1346642 | 2/1974 |
| SU | 1114585 A2 | 9/1984 |

* cited by examiner

*Primary Examiner* — Edwin Swinehart
(74) *Attorney, Agent, or Firm* — Laurence A. Greenberg; Werner H. Stemer; Ralph E. Locher

(57) ABSTRACT

The invention relates to a hydrofoil arrangement for a hydrofoil craft with at least one fully submerged lifting wing. The hydrofoil arrangement includes at least two struts pivotally arranged on the hydrofoil craft with each strut being connected to a lifting wing. The struts are arranged with their centers of effort of hydrodynamic forces behind the pivot axes of the struts during forward travel of the hydrofoil craft. They are arranged to pivot relative to the hydrofoil craft when the hydrofoil craft experiences a disturbance in roll-angle. This results in a transversal movement of the hydrofoil craft relative to the water surface during forward travel. The hydrofoil arrangement also increases the roll- stability for a hydrofoil craft.

8 Claims, 12 Drawing Sheets

HYDROFOIL ARRANGEMENT

TECHNICAL FIELD OF THE INVENTION

The present invention relates to a hydrofoil arrangement for a hydrofoil craft with at least one fully submerged lifting wing as stated in the preamble of claim 1.

BACKGROUND OF THE INVENTION

Field of the Invention

Hydrofoil craft where the lifting wings are fully submerged below the water's surface and attached to the craft by surface-piercing struts are the most efficient kind of hydrofoil craft. This is because ventilation on the low-pressure side of the lifting wing can easily be avoided, providing a better lift/drag ratio than if the lifting wing is surface-piercing. The surface-piercing support-struts for the fully submerged wing have relatively small hydrodynamic lift, so ventilation does not cause so much drag on them.

A problem with hydrofoil craft with fully submerged lifting wings is that they are unstable in roll. This instability occurs because the craft's centre of gravity is above the centre of effort for hydrodynamic forces on the struts connecting the craft with the lifting wing or lifting wings.

To overcome this problem, a system of gyros, accelerometers and a computer can control servos that actuate ailerons on the lifting wing or lifting wings. Such a system is employed on e.g., Boeing Jetfoil (Jane's High-Speed Marine Craft and Air-Cushion Vehicles 1987, page 177).

U.S. Pat. No. 3,710,747 A provides another way of addressing the problem of roll-stability for such craft by rotating the struts around vertical axes, perpendicular to the lifting wing, to minimise side-forces on the struts due to transversal movement of water in waves.

SUMMARY OF THE INVENTION

The problem of roll-stability for hydrofoil craft with at least one fully submerged lifting wing is solved according to the invention by a hydrofoil arrangement.

By that the hydrofoil arrangement comprises the characteristic features that the struts are arranged with their centers of effort of hydrodynamic forces behind the pivot axes of the struts during forward travel of the hydrofoil craft, whereby the struts are arranged to pivot relative to the hydrofoil craft when the hydrofoil craft experiences a disturbance in roll-angle, this resulting in a transversal movement of the hydrofoil craft relative to the water surface during forward travel, where the struts when pivoting are arranged to actuate through a direct mechanical coupling at least one means for inducing transversal displacement of the resulting lifting wing's centre of effort in the direction of the transversal movement of the hydrofoil craft in order to modify the transversal distribution of pressure on the at least one lifting wing, whereby the hydrofoil craft is arranged to roll back to equilibrium, the advantage of obtaining a hydrofoil arrangement where roll-stability and compensation for roll-moments due to waves is obtained independently of servo-motors or electronic control systems, is achieved.

Further preferred exemplary embodiments are defined in the dependent claims.

In one embodiment, the hydrofoil arrangement comprises one lifting wing.

In another embodiment, the hydrofoil arrangement comprises more than one lifting wing, e.g. two lifting wings.

In a further embodiment, the hydrofoil arrangement comprises ailerons for modifying the spanwise distribution of lift.

In an embodiment, the hydrofoil arrangement comprises a lifting wing allowing for torsional deflection.

According to a second aspect of the present invention a hydrofoil craft is provided. The hydrofoil craft comprises a hydrofoil arrangement comprising at least two struts to be pivotally arranged on the hydrofoil craft, and at least one lifting wing arranged to be fully submerged, wherein each strut is connected to a lifting wing. The hydrofoil craft is characterized in that the struts are arranged with their centres of effort of hydrodynamic forces behind the pivot axes of the struts during forward travel of the hydrofoil craft, whereby the struts, when the hydrofoil craft during forward travel experiences a disturbance in roll-angle resulting in a transversal movement of the hydrofoil craft relative to the water surface, are arranged to pivot relative to the hydrofoil craft where the struts when pivoting are arranged to actuate through a direct mechanical coupling at least one means for inducing transversal displacement of the resulting lifting wing's centre of effort in the direction of the transversal movement of the hydrofoil craft in order to modify the transversal distribution of pressure on the at least one lifting wing, whereby the hydrofoil craft is arranged to roll back to equilibrium.

The hydrofoil craft according to the invention may be provided with a hydrofoil arrangement comprising the features from any one of the claims.

DESCRIPTION OF THE INVENTION

Figure 1:
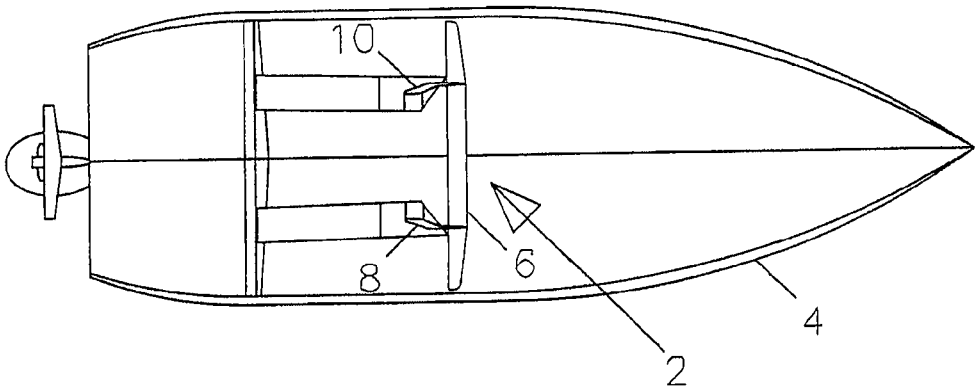
FIG. 1 shows schematically a bottom view of a hydrofoil arrangement according to a first preferred embodiment of the invention installed in a hydrofoil craft.

FIG. 1 shows schematically a bottom view of a hydrofoil arrangement 2 according to a first preferred embodiment of the invention installed in a hydrofoil craft 4 with a during operation fully submerged lifting wing 6 connected to the craft 4 by two surface-piercing struts 8, 10.

Figure 2:
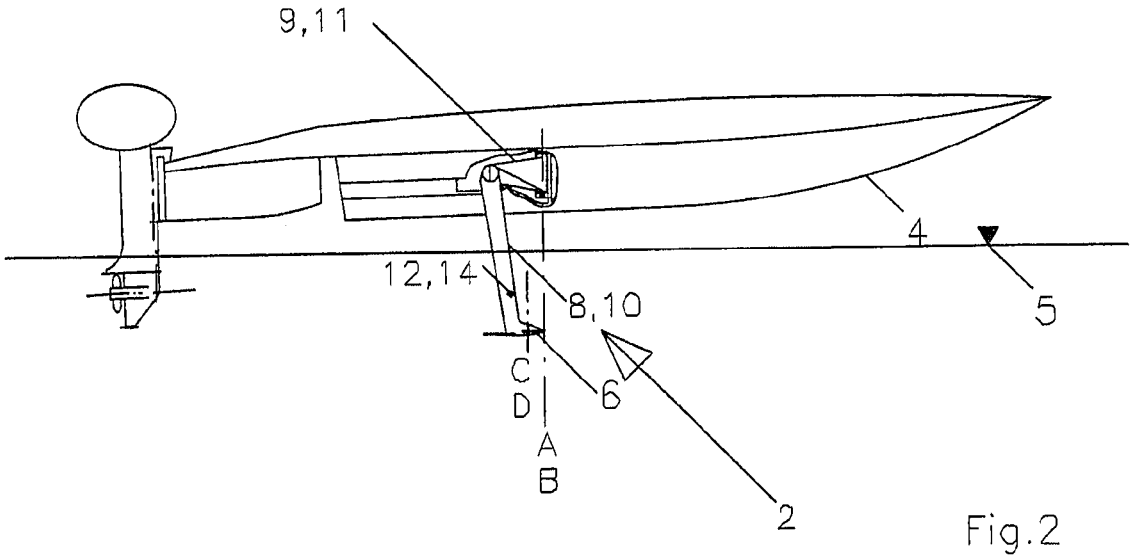
FIG. 2 shows schematically a partly sectioned side view of the hydrofoil arrangement shown in FIG. 1.

FIG. 2 shows schematically a partly sectioned side view of the hydrofoil arrangement 2 shown in FIG. 1, where the lifting wing 6 and the starboard strut 10 is shown. The hydrofoil 4 craft is lifted above the water's surface 5 by the hydrofoil arrangement 2. The lifting wing 6 is designed in a way to allow torsional deflection of the lifting wing 6 between the struts 8, 10. The port strut 8 is arranged in a similar but mirrored way as the starboard strut 10 to the hydrofoil craft 4. Both struts 8, 10 are attached on their respective strut mounting units 9, 11. Thus the port strut 8 is pivotably attached to the hydrofoil craft 4 at a transversally upwards towards the centre of the hydrofoil craft 4 inclined axis A (see also FIG. 3) and the starboard strut 10 is in a corresponding way pivotably attached to the hydrofoil craft 4 at a transversally upwards towards the centre of the hydrofoil craft 4 inclined axis B (see also FIG. 3), where each strut 8, 10 can pivot relative the hydrofoil craft 4 around the respective pivot axes A and B. As is shown in the figure, the respective pivot axes A and B lie forward of the centre of effort 12, 14 of the respective strut 8, 10. The struts 8, 10 are attached to the lifting wing 6 in a way so that each strut 8, 10 further also can pivot around another respective pivot axis C, D relative the lifting wing 6. Pivot axis C for the port strut is perpendicular to the wing or less inclined towards the centre of the craft 4 than pivot axis B, while pivot axis D for the starboard strut is perpendicular to the wing or less inclined towards the centre of the craft 4 than pivot axis B. Thus there exists an angle +μ between the two axes A and C related to the port strut 8, and a corresponding angle −μ between the two axes B and D related to the starboard strut 10, as seen from the rear across the hydrofoil craft 4, see also FIG. 3.

As an alternative, the port strut 8 could be pivotably attached to the hydrofoil craft 4 at a transversally directly upwards or away from the centre of the hydrofoil craft 4 inclined axis A and the starboard strut 10 could in a corresponding way be pivotably attached to the hydrofoil craft 4 at a transversally directly upwards or away from the centre of the hydrofoil craft 4 inclined axis B, where each strut 8, 10 can pivot relative the hydrofoil craft 4 around the respective pivot axes A and B. In this alternative embodiment the respective pivot axes C, D for the respective struts pivotable attachment in the lifting wing 6 would be arranged at transversally away from the centre of the hydrofoil craft 4 inclined angles. Also for this alternative embodiment there exists an angle +μ between the two axes A and C related to the port strut 8, and a corresponding angle −μ between the two axes B and D related to the starboard strut 10, as seen from the rear across the hydrofoil craft 4 (this embodiment is not shown in the figures as it is a possible but not preferred embodiment due to the torsional moment and hence, torsional deflection, such a design would place on the strut).

Figure 3:
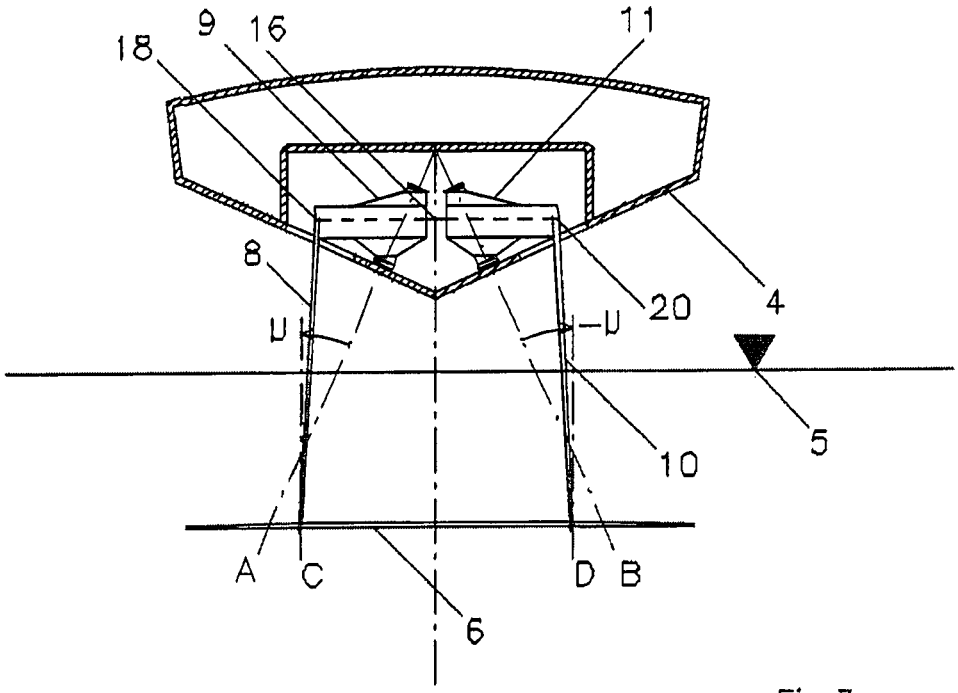
FIG. 3 shows schematically a partly sectioned back view of the hydrofoil arrangement shown in FIG. 1.

FIG. 3 shows schematically a partly sectioned back view of the hydrofoil arrangement shown in FIG. 1. As mentioned above, the port strut 8 is pivotably attached to the hydrofoil craft 4 at a transversally upwards towards the centre of the hydrofoil craft 4 inclined axis A and the starboard strut 10 is in a corresponding way pivotably attached to the hydrofoil craft 4 at a transversally upwards towards the centre of the hydrofoil craft 4 inclined axis B, where each strut 8, 10 can pivot relative the hydrofoil craft 4 around the respective pivot axes A and B. The respective strut mounting units 9, 11 are also arranged to pivot together with their respective struts relative the hydrofoil craft 4 around the respective pivot axes A and B. The struts 8, 10 are as mentioned above attached to the lifting wing 6 in a way so that each strut 8, 10 further also can pivot around another respective pivot axis C, D relative the lifting wing 6. As shown in the figure, the respective axes C and D are preferably close to the respective struts 8, 10, in a view from the rear of the struts 8,10, in order to minimise undesired torsional deflection of the struts 8, 10 due to load on the hydrofoil arrangement 2. The angle +μ between the two axes A and C related to the port strut 8, and the corresponding angle −μ between the two axes B and D related to the starboard strut 10 are also shown in the figure. In the embodiment shown in the figure, the struts 8, 10 are connected with a linking device 16, e.g. a rod or a similar device, that is pivotally attached between the upper parts 18, 20 of the struts 8, 10. The linking device can also be a wire, attached between the upper parts 18, 20 of the struts 8, 10. This linking device 16 forces the vertical component of the rotation of the respective struts 8, 10 in the same direction.

In this embodiment, the direct mechanical coupling comprises a linking device 16, arranged to ensure that the vertical components of the rotation of the respective struts 8, 10 are in the same direction, and further comprises the pivotal struts 8, 10.

In this embodiment, the means for inducing transversal displacement of the resulting lifting wing's centre of effort is the lifting wing 6 itself being arranged to deflect torsionally around a transversal axis between the struts 8, 10.

Figure 4:
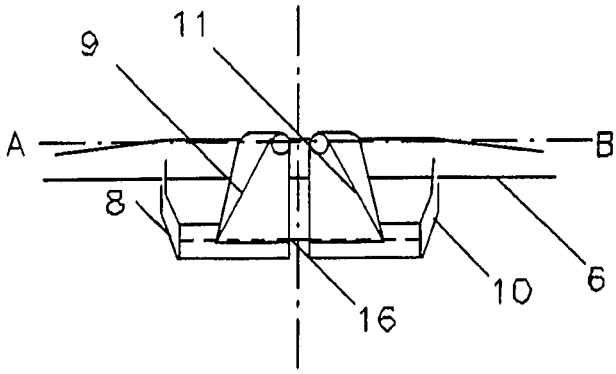
FIG. 4 shows schematically a top view of the hydrofoil arrangement shown in FIG. 1.

FIG. 4 shows schematically a top view of the hydrofoil arrangement shown in FIG. 1, showing the respective struts 8, 10, the respective strut mounting units 9, 11, the lifting wing 6 designed to allow torsional deflection of the lifting wing 6 between the struts 8, 10, and the linking device 16.

Figure 5:
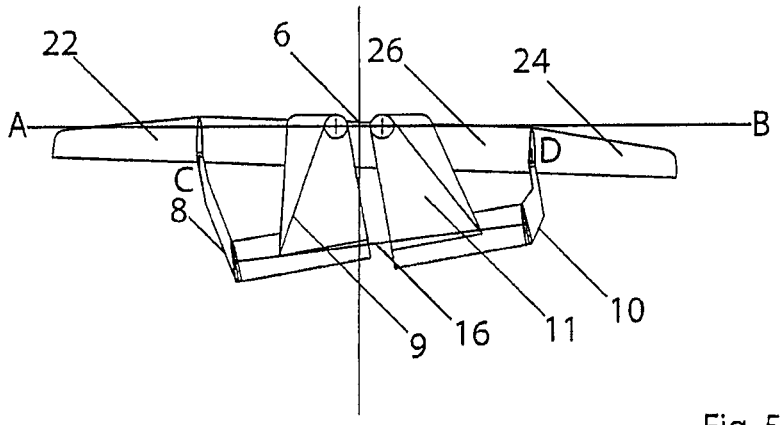
FIG. 5 shows schematically a top view of the mechanical coupling between torsional deflection of the wing and rotation of struts of the hydrofoil arrangement shown in FIG. 1-4.

FIG. 5 shows schematically a top view of the mechanical coupling between torsional deflection of the lifting wing 6 and rotation of struts 8, 10 of the hydrofoil arrangement shown in FIGS. 1-4. From the figure can be seen, that the port strut 8 together with its strut-mounting unit 9 rotates around axis A relative the hydrofoil craft 4, while the starboard strut 10 together with its strut-mounting unit 11 rotates around axis B relative the hydrofoil craft 4. The linking device 16 ensures that the vertical component of the rotation of the respective struts 8, 10 are in the same direction. FIG. 5 shows both struts 8, 10 displaced in the anti-clockwise direction as seen in the top view.

Figure 6:
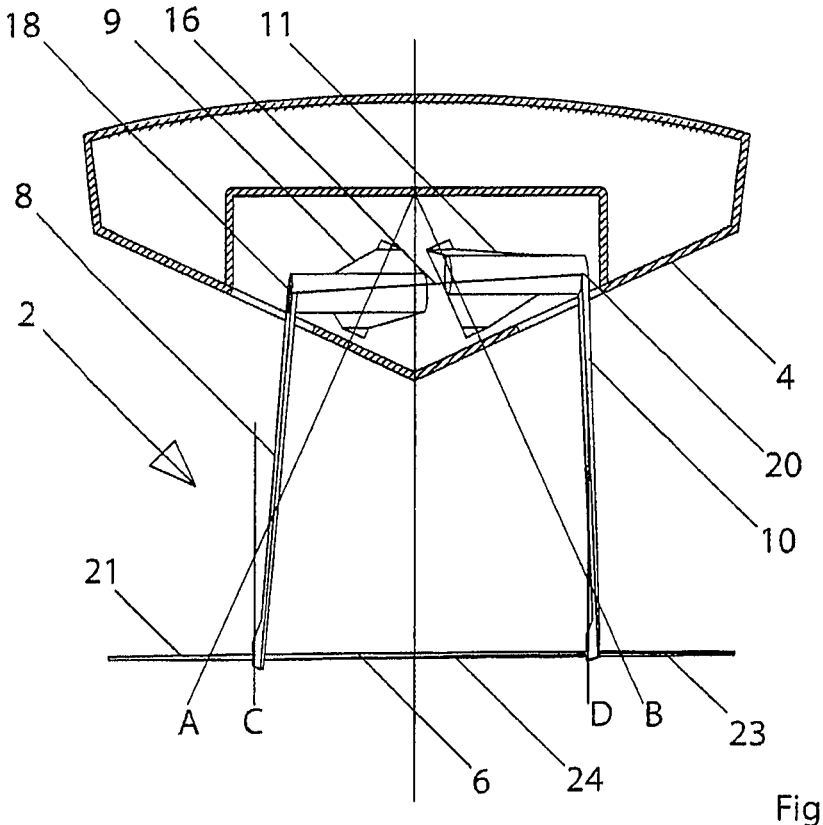
FIG. 6 shows schematically a partly sectioned back view of the mechanical coupling between torsional deflection of the wing and rotation of struts of the hydrofoil arrangement shown in FIG. 1-5, FIGS. 7 and 7*a* show schematically a side view of the mechanical coupling between torsional deflection of the wing and rotation of struts of the hydrofoil arrangement shown in FIGS. 1-6.

FIG. 6 shows schematically a partly sectioned back view of the mechanical coupling between torsional deflection of the lifting wing 6 and rotation of the respective struts 8, 10 of the hydrofoil arrangement 2 shown in FIGS. 1-5. In the figure is also shown the to the anticlockwise rotation of the respective strut 8, 10 corresponding position of the linking device 16 and further also to the anticlockwise rotation of the respective strut 8, 10 corresponding positions of the respective strut mounting units 9, 11. As can be seen from the figure, the respective strut mounting units 9, 11 have assumed a position where the respective upper parts 18, 20 of the struts 8, 10 are at a differing vertical position in relation to the horizontal plane of the hydrofoil craft 4, this resulting in that the linking device 16 attached between the upper parts 18, 20 of the struts 8, 10 assumes an inclined position in relation to the horizontal plane of the hydrofoil craft 4. FIG. 6 also shows the lifting wing's 6 port side 21 that assumes the same angular displacement around a transversal axis as the pivoting axis C. In a similar way the lifting wing's 6 starboard side 23 assumes the same angular displacement around a transversal axis as the pivoting axis D, see further FIG. 7*a*. FIG. 6 also shows the lifting wing 6 between the struts 8, 10, i.e. of the lifting wing part 24 arranged between the respective struts 8, 10. This central part 24 of the lifting wing 6 will assume a torsional deflection when the port side 21 and the starboard side 23 of the lifting wing 6 assume angular displacements in opposite directions around a transversal axis.

Figure 7:
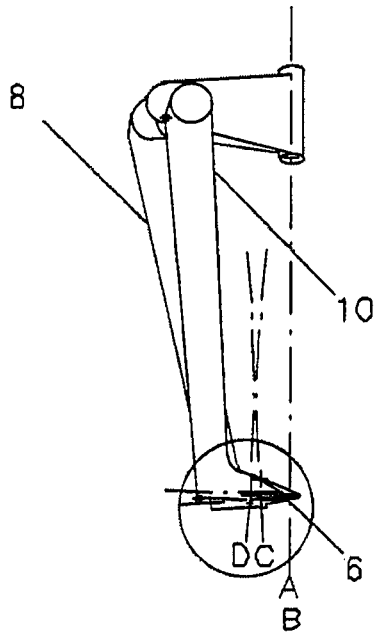
Figure 7A:
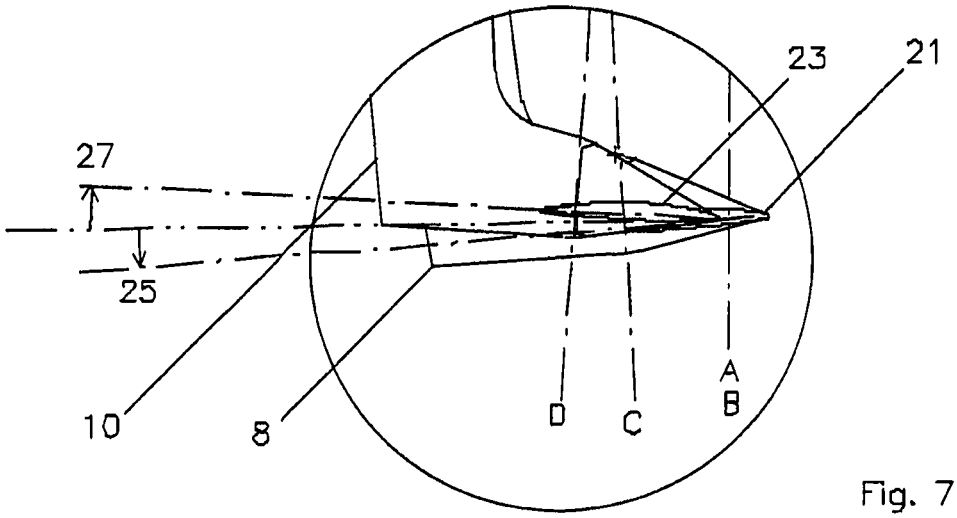

FIGS. 7 and 7*a* shows schematically a side view of the mechanical coupling between torsional deflection of the lifting wing 6 and rotation of the respective struts 8, 10 of the hydrofoil arrangement 2. With the orientation of axes A, B, C, and D according to what is shown in FIGS. 1-6, anticlockwise vertical components of the rotation of the respective struts 8, 10 correspond to a nose-up rotation 25 of the port side 21 of the lifting wing 6 and a nose-down rotation 27 of the starboard side 23 of the lifting wing, as shown in FIG. 7*a*. The rotation of the respective struts 8, 10 will thus also cause a torsional deflection of the lifting wing 6 between the struts 8, 10, i.e. of the lifting wing part 24 arranged between the respective struts 8, 10. In the figure is also shown the respective strut mounting units 9, 11, and the linking device 16.

Figure 8:
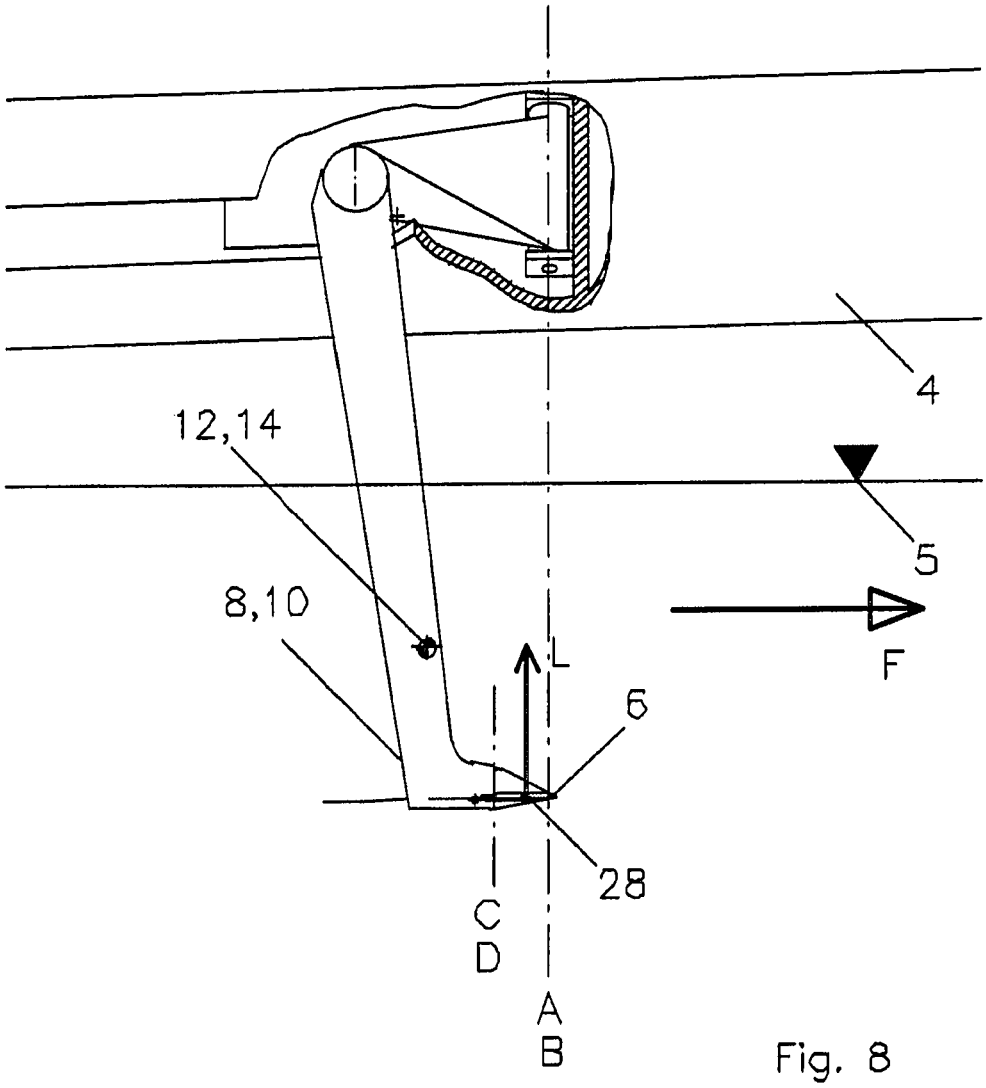
FIG. 8 shows schematically how the centre of effort of hydrodynamic forces on the struts lie further behind the pivot axes of the struts, than the centre of effort for hydrodynamic force on the lifting wing does.

FIG. 8 shows schematically how the centre of effort 12, 14 of hydrodynamic forces on the respective struts 8, 10 preferably lie further behind the pivot axes A, B of the struts 8, 10 than the centre of effort 28 for hydrodynamic force L on the lifting wing 6 does, as seen in the general forward travel direction F of the hydrofoil craft 4. This allows for the necessary transversal displacement of the centre of effort 28 of the lifting wing 6 with a smaller side-force on the struts 8, 10 than the side force on the struts 8, 10 would be if the centre of effort 28 of the lifting wing 6 and the centre of effort 12, 14 of hydrodynamic forces on the respective struts 8, 10 would have the same longitudinal position as seen in the general forward travel direction F of the hydrofoil craft 4. This also leads to an increased larger roll-stability for the hydrofoil craft 4.

Figure 9:
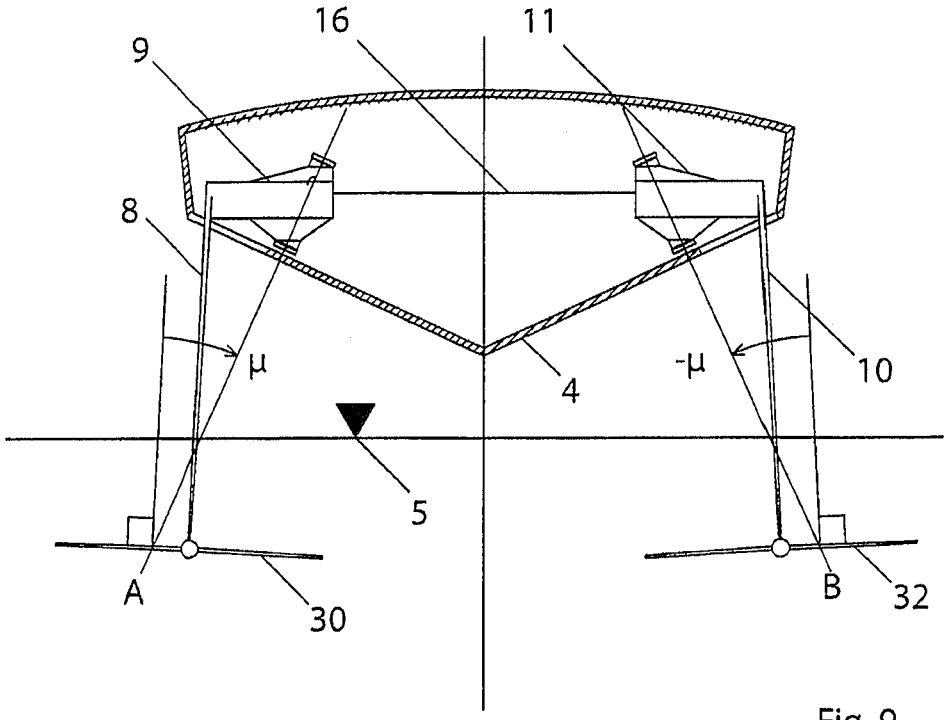
FIG. 9 shows schematically a partly sectioned back view according to a second embodiment of the invention, where one lifting wing is solidly attached on each strut.

FIG. 9 shows schematically a partly sectioned back view according to a second embodiment of the invention installed in a hydrofoil craft 4 with during operation fully submerged lifting wings 30, 32 connected to the craft 4 by two respective struts 8, 10, where one lifting wing 30, 32 is solidly attached on each respective strut 8, 10. The port strut 8 is pivotably attached to the hydrofoil craft 4 at a transversally upwards towards the centre of the hydrofoil craft 4 inclined axis A and the starboard strut 10 is in a corresponding way pivotably attached to the hydrofoil craft 4 at a transversally upwards towards the centre of the hydrofoil craft 4 inclined axis B, where each strut 8, 10 can pivot relative the hydrofoil craft 4 around the respective pivot axes A and B. The respective strut mounting units 9, 11 are also arranged to pivot relative the hydrofoil craft 4 around the respective pivot axes A and B. The strut 8 on the port side is attached to the hydrofoil craft 4 so that the port strut 8 can rotate around an axis A at an angle $+\mu$ to the perpendicular of the port lifting wing 30, while another strut 10 on the starboard side is attached to the hydrofoil craft 4 so that the starboard strut 10 can rotate around an axis B at an angle $-\mu$ to the perpendicular of the starboard lifting wing. The struts are connected with a linking device 16 as mentioned above in connection with the embodiment described in FIGS. 1-8 to ensure that the vertical components of the rotation of the respective struts 8, 10 are in the same direction. This linking device 16 is attached between the rear parts of the strut mounting units 9, 11.

In this embodiment, the direct mechanical coupling comprises a linking device 16, arranged to ensure that the vertical components of the rotation of the respective struts 8, 10 are in the same direction, and further comprises the pivotal struts 8, 10.

In this embodiment, the means for inducing transversal displacement of the resulting lifting wing's centre of effort are the lifting wings themselves being arranged to rotate together with the respective strut.

This embodiment is stable in a way similar to the first embodiment, but here the entire lifting wings 30, 32 can rotate together with their respective struts 8, 10 so the transversal components of the rotation of the respective lifting wings 30, 32 wings are in opposite directions, while the vertical components are in the same direction.

Also for this embodiment, in the way discussed in connection with FIG. 8, the centre of effort 12, 14 of hydrodynamic forces on the respective struts 8, 10 preferably lie further behind the pivot axes A, B of the struts 8, 10 than the centre of effort 28 for hydrodynamic force L on the respective lifting wings 30, 32 does, as seen in the general forward travel direction F of the hydrofoil craft 4. This allows for the necessary transversal displacement E of the centre of effort 28 of the lifting wings 30, 32 with a smaller side-force on the struts 8, 10 than the side force on the struts 8, 10 would be if the centre of effort 28 of the lifting wings 30, 32 and the centre of effort 12, 14 of hydrodynamic forces on the respective struts 8, 10 would have the same longitudinal position as seen in the general forward travel direction F of the hydrofoil craft 4. This also leads to an increased roll-stability for the hydrofoil craft 4.

Figure 10:
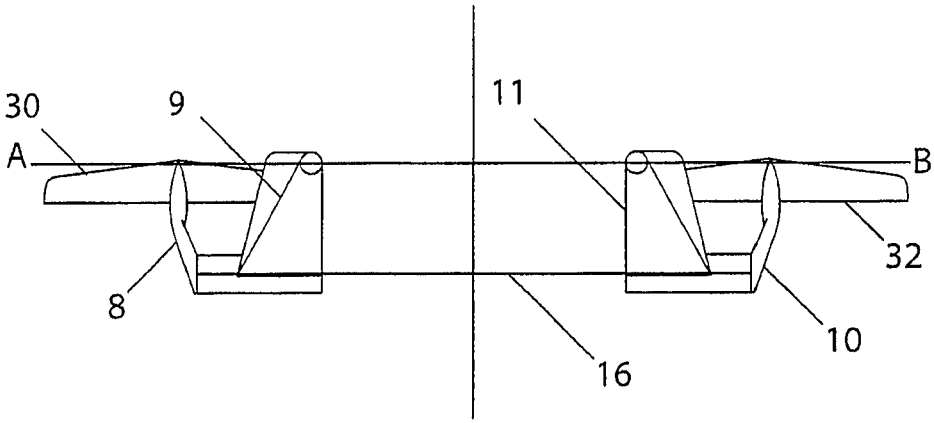
FIG. 10 shows schematically a top view of the hydrofoil arrangement shown in FIG. 9, FIGS. 11 and 11*a* show schematically a partly sectioned side view according to a third embodiment of the invention, where rotation of the struts actuates ailerons on the lifting wing.

FIG. 10 shows schematically a top view of the hydrofoil arrangement shown in FIG. 9, showing the respective struts 8, 10, the respective strut mounting units 9, 11, the respective lifting wings 30, 32 solidly attached on each respective strut 8, 10, and the linking device 16.

Figure 11:
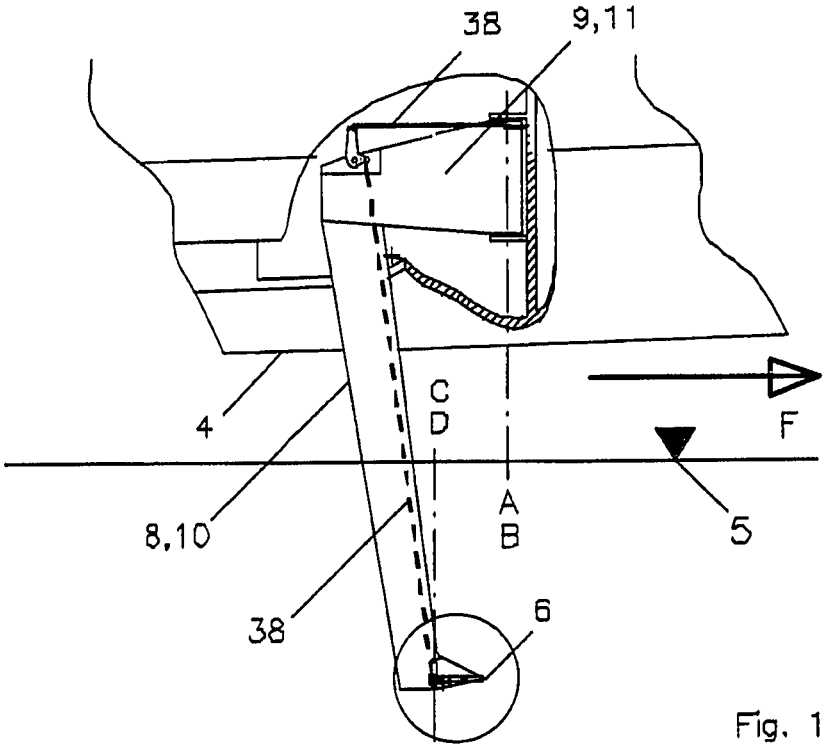
Figure 11A:
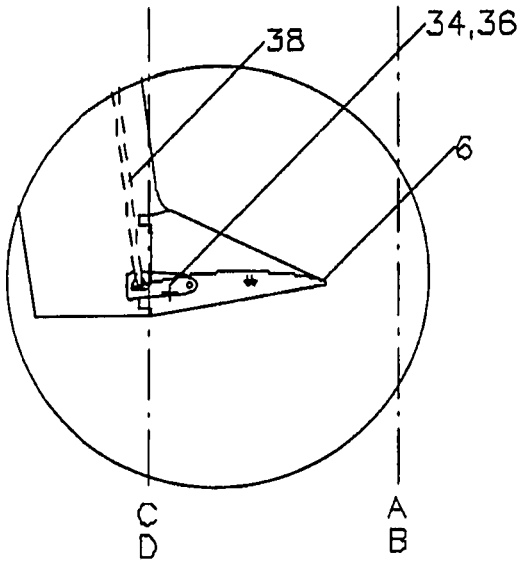

FIGS. 11 and 11*a* show schematically a partly sectioned side view according to a third embodiment of the invention installed in a hydrofoil craft 4 with a during operation fully submerged lifting wing 6 connected to the hydrofoil craft 4 by two struts 8, 10. The port strut 8 is pivotably attached to the hydrofoil craft 4 at an axis A and the starboard strut 10 is in a corresponding way pivotably attached to the hydrofoil craft 4 at an axis B, where each strut 8, 10 can pivot relative the hydrofoil craft 4 around the respective pivot axes A and B. The respective strut mounting units 9, 11 are also arranged to pivot together with their respective strut relative the hydrofoil craft 4 around the respective pivot axes A and B. This embodiment differs from the embodiment described in FIGS. 1-8 in that in the embodiment according to FIG. 11 and 11*a* rotation of the struts 8, 10 actuates ailerons 34, 36 arranged on the lifting wing 6, where the rotation of the respective strut 8, 10 is mechanically coupled by a linking device 38, e.g. a link mechanism, to the movement of the respective ailerons 34, 36 arranged on the lifting wing 6. Thus, when the respective struts 8, 10 pivot around the respective pivot axes A, B, due to an additional transversal movement of the hydrofoil craft 4 relative the water, the respective struts 8, 10 actuate the respective ailerons 34, 36 through a respective linking device 38, whereby the respective ailerons 34, 36 modify the spanwise distribution of lift so the hydrofoil craft 4 rolls back to equilibrium as discussed further below.

In this embodiment, the direct mechanical coupling comprises a respective linking device 38 arranged at the respective strut 8, 10.

In this embodiment, the means for inducing transversal displacement of the resulting lifting wing's centre of effort are ailerons 34, 36 arranged on the lifting wing 6 and with their respective movements mechanically coupled by the respective linking devices 38 to the rotation of the respective struts 8, 10.

The struts 8, 10 are attached to the lifting wing 6 in a way so that each strut 8, 10 further also can pivot around another respective pivot axis C, D relative the lifting wing 6 as the struts 8, 10 are further pivotable connected to the lifting wing 6 at lower strut pivot axes C, D. As shown in the figure, the respective axes C and D are preferably close to the respective struts 8, 10 when seen from the rear across the hydrofoil craft 4, in order to minimise undesired torsional deflection of the struts 8, 10 due to load on the hydrofoil arrangement 2.

Figure 12:
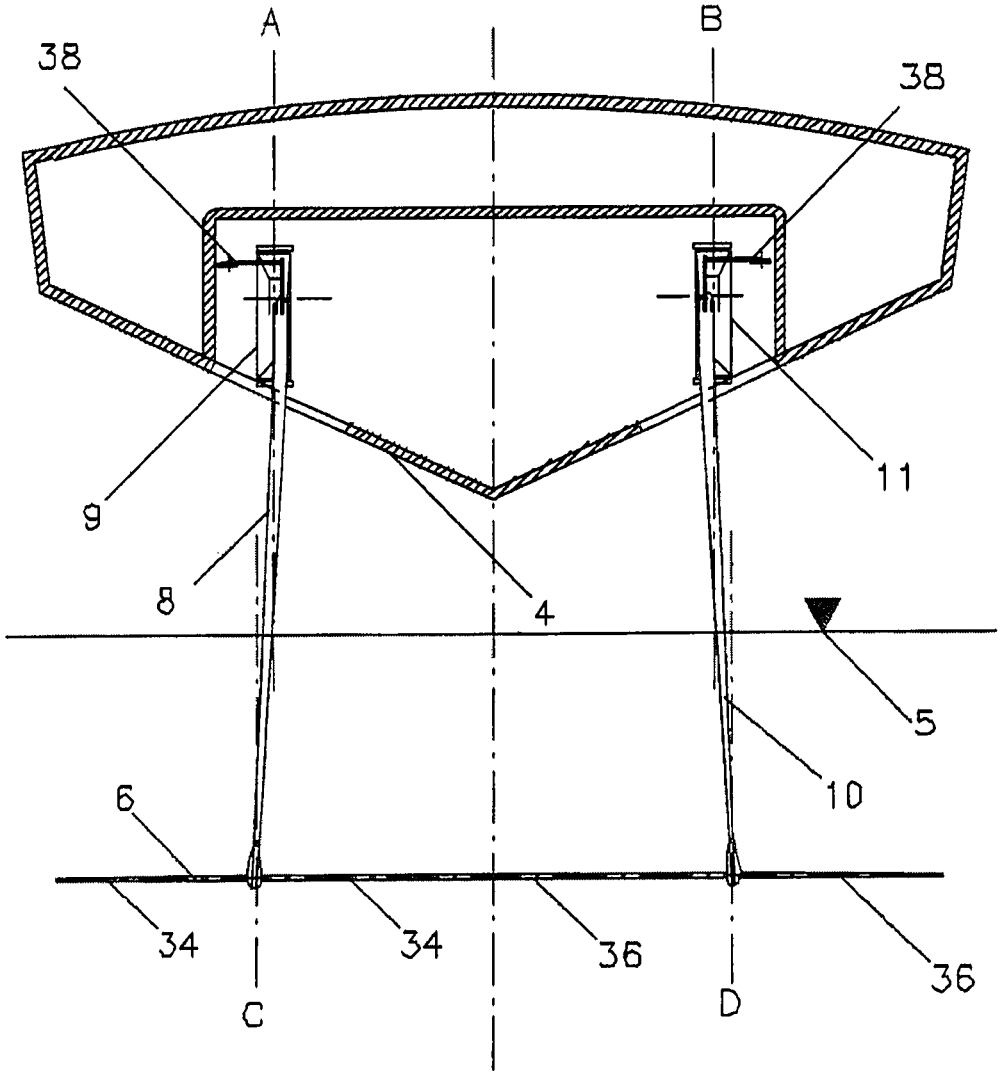
FIG. 12 shows schematically a partly sectioned back view of the hydrofoil arrangement shown in FIG. 11, FIGS. 13 and 13*a* show schematically a top view of the hydrofoil arrangement shown in FIG. 11.

FIG. 12 shows schematically a partly sectioned back view of the hydrofoil arrangement shown in FIGS. 11 and 11*a*, showing the respective struts 8, 10, the respective strut mounting units 9, 11, the lifting wing 6, the respective ailerons 34, 36 and the respective linking devices 38.

Figure 13:
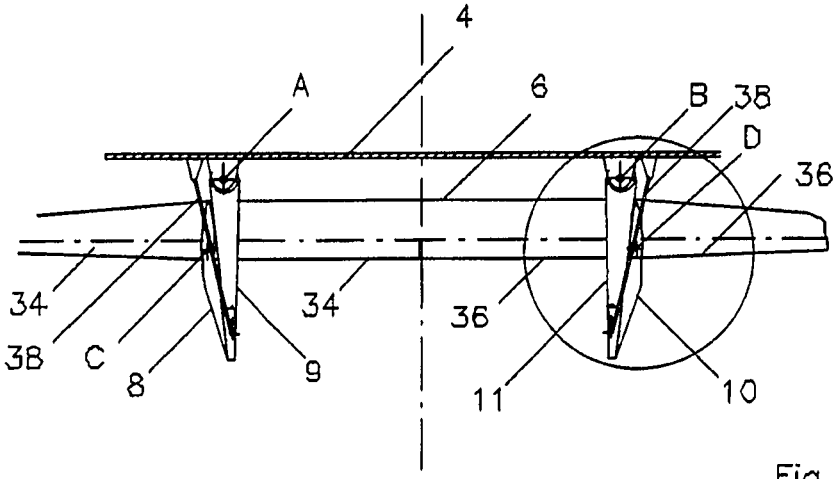
Figure 13A:
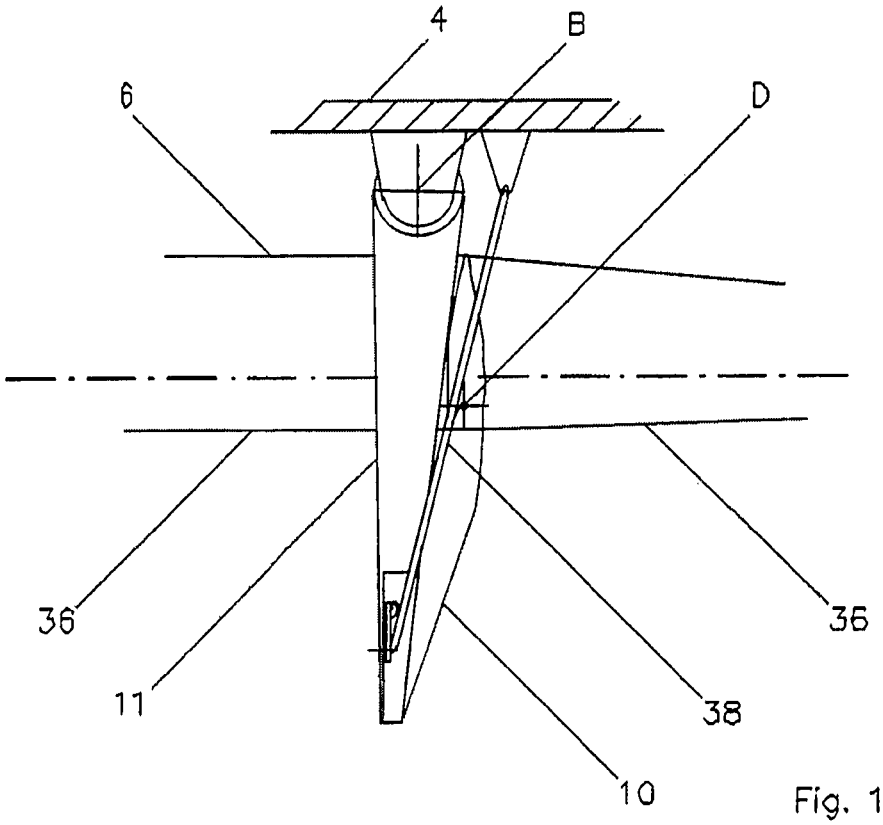

FIGS. 13 and 13*a* show schematically a top view of the hydrofoil arrangement shown in FIGS. 11 and 11*a*, showing the respective struts 8, 10, the lifting wing 6, the respective ailerons 34, 36, and the respective linking devices 38.

Figure 14:
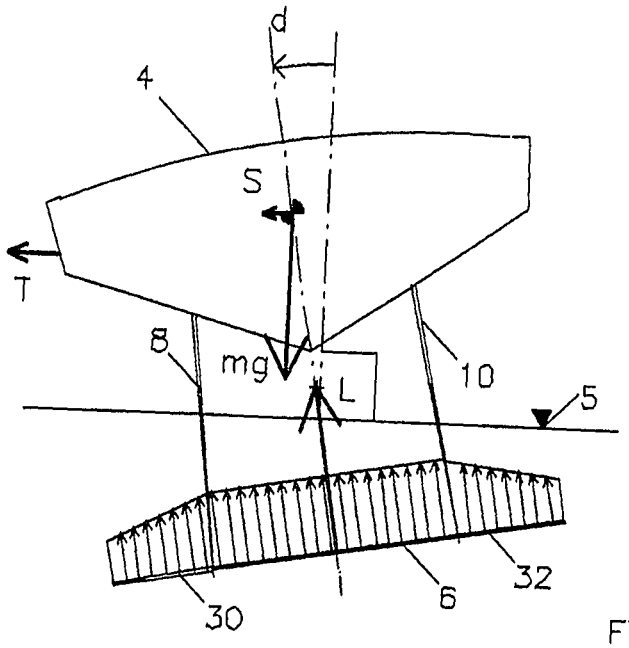
FIG. 14 shows schematically how the lift of the wing and gravity results in a side-force when the craft get a disturbance in roll-angle.

FIG. 14 shows schematically how the lift L of the lifting wing 6 and gravity mg results in a side-force S when the hydrofoil craft 4 receives a disturbance in roll-angle. In this figure, the lifting wing or lifting wings is/are exemplified using one lifting wing 6, but the theory also applies to a hydrofoil craft 4 where the lifting wing 6 also could be replaced by more than one lifting wing, e.g. two lifting wings 30, 32. In the figure is shown how a disturbance in roll-angle d makes the resulting sideforce S of lift L and gravity mg to act in the direction of the disturbance. This resulting sideforce causes an additional movement T of the hydrofoil craft 4 in the direction of the side force S.

Figure 15:
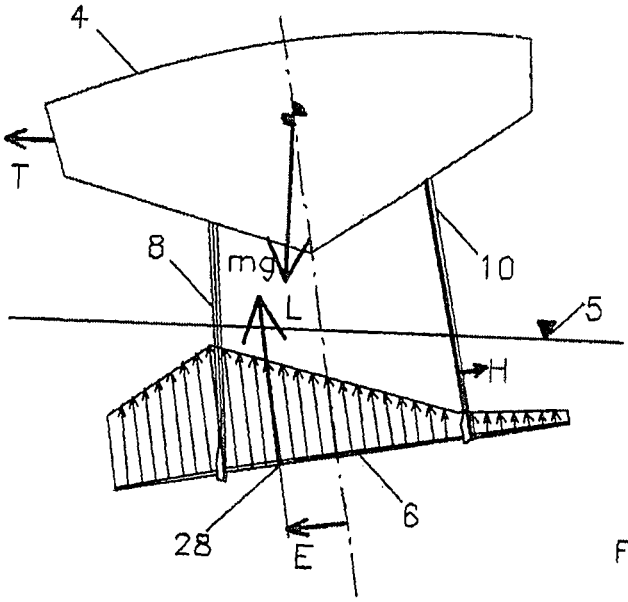
FIG. 15 shows schematically the rotation of the struts due to the transversal movement caused by the side-force, and how the transversal distribution of lift get altered because the invention.

FIG. 15 shows schematically how the transversal distribution of lift L is modified resulting from said additional transversal movement T in FIG. 14 for the embodiments of hydrofoil arrangements with one lifting wing 6 described herein. In the figure is shown how this transversal movement of the struts 8, 10 causes a side-force H on the struts 8, 10 (only shown for strut 10 in the figure in order not to obscure the schematic representation of distribution of lift across the lifting wing 6), whereby the struts 8, 10 pivot relative the hydrofoil craft 4. This pivot movement of the respective struts 8, 10 is mechanically coupled with some means for creating a modification of the spanwise distribution of lift Las described above. In the figure is shown how the deflection of the lifting wing 6 or actuation of ailerons 34,36 causes a transversal displacement E of the centre of effort 28 for the span wise distribution of lift L, so that the hydrofoil craft 4 rolls back to equilibrium, as shown in FIG. 17.

Figure 16:
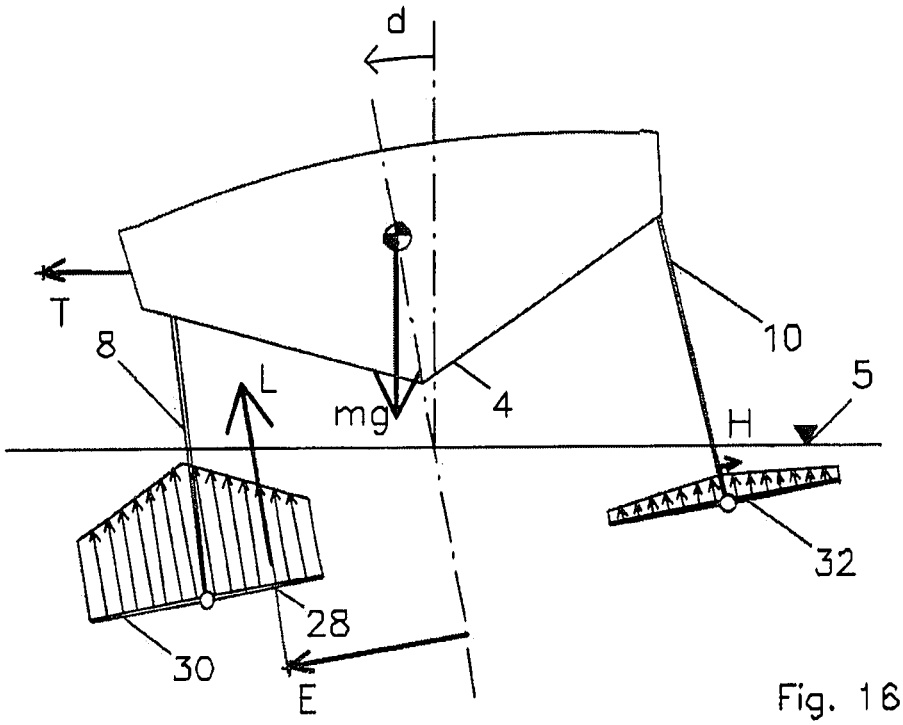
FIG. 16 shows schematically how the transversal distribution of lift get altered because the side-force for a hydrofoil arrangement with two lifting wings according to the invention.

FIG. 16 shows schematically how the transversal distribution of lift L is modified resulting from said additional transversal movement T of the craft 4 in the direction of the sideforce S in a similar way as in FIG. 14 for the second embodiment, described in FIGS. 9 and 10. In the figure is shown how this transversal movement of the struts 8, 10 causes a side-force H on the struts 8, 10 (only shown for strut 10 in the figure in order not to obscure the schematic representation of distribution of lift across the lifting wings 30, 32), whereby the struts 8, 10 pivot relative the hydrofoil craft 4. This pivot movement of the respective struts 8, 10 is mechanically coupled with rotational displacement of the wings around a transversal axis in opposite direction for port wing 30 and starboard wing 32 in a similar way as described in FIG. 7*a*, which causes a transversal displacement E of the centre of effort 28 for the span wise distribution of lift L, so that the hydrofoil craft 4 rolls back to equilibrium, as shown in FIG. 17.

Figure 17:
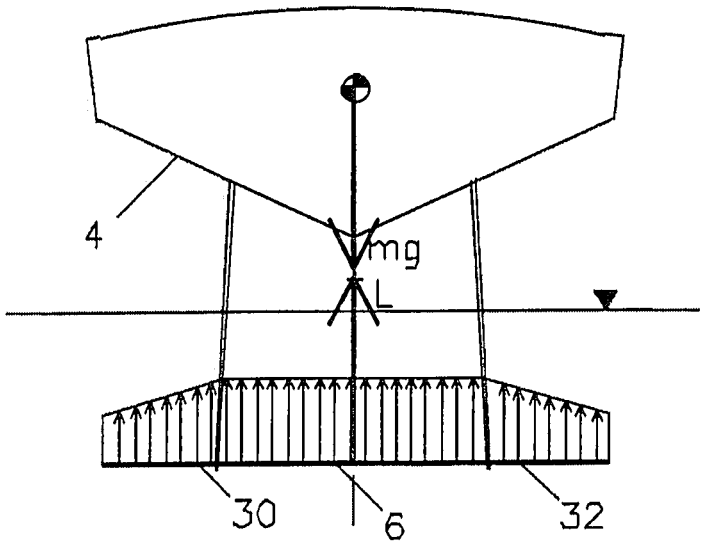
FIG. 17 shows schematically the lift of the wing and gravity when the craft has rolled back to equilibrium.

FIG. 17 shows schematically the lift L of the lifting wing 6 or wings 30, 32 and gravity when the hydrofoil craft 4 has rolled back to equilibrium.

The angle of the respective axes A, B, C, and D in relation to the longitudinal axis of the hydrofoil craft has not been discussed above. In one preferred embodiment, these axes are at right angles to the respective lifting wing as seen along the longitudinal axis of the hydrofoil craft, but said axes could also be angled in a forward or a backward direction of the hydrofoil craft.

Figure 18:
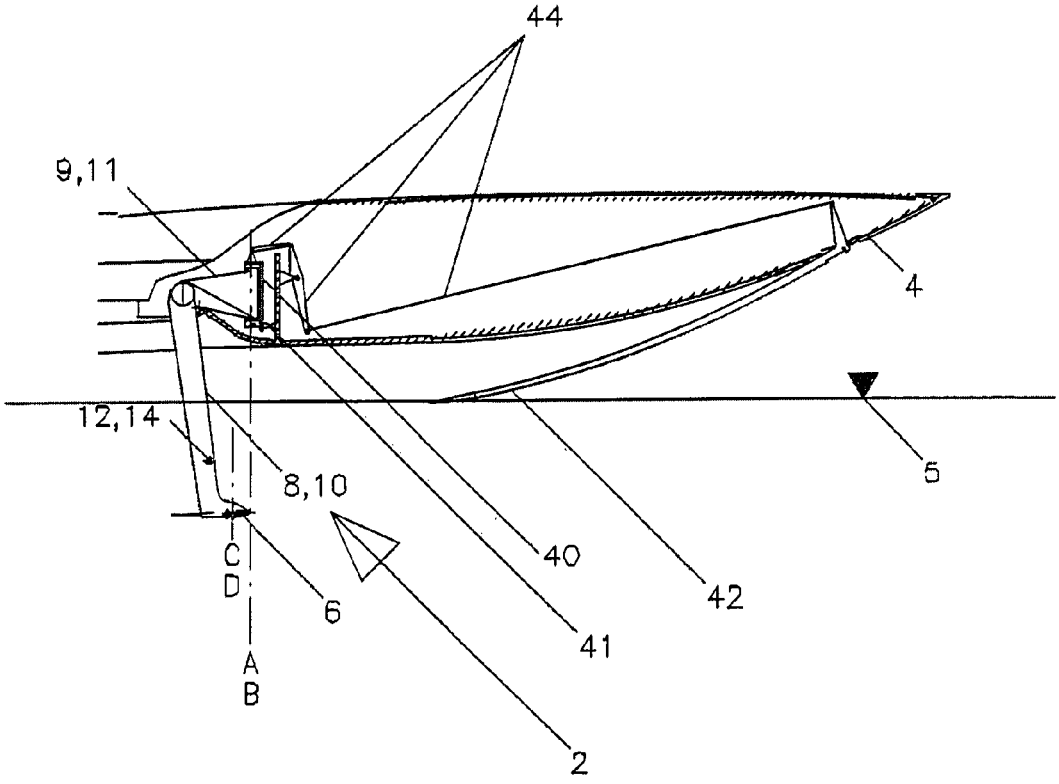
FIG. 18 shows schematically a partly sectioned starboard view of how the hydrofoil arrangement can be arranged to pivot in order to regulate the angle of attack of the lifting wing or lifting wings.

FIG. 18 shows schematically a partly sectioned starboard view of an alternative embodiment of the invention according to which the pivot axes A and B are attached on a support 40. The support is arranged rotatable around a transversal axis 41 relative the hydrofoil craft 4, so that the hydrofoil arrangement 2, comprising the pivot axes A and B, the strut mounting units 9, 11, the linking device 16, the struts 8, 10, the pivot axes C and D and the lifting wing 6 or lifting wings 30, 32, follows the rotation of the support around the transversal axis 41. The support 40 can be connected to a surface-sensor 42 via a linking mechanism 44 in order to control the angular position of the hydrofoil arrangement 2 and hence, the lifting wing's 6 or lifting wings' 30, 32 angle of attack. Hence, the flying altitude can be regulated.

As discussed above, the hydrofoil arrangement according to the present invention provides for a way to obtain roll-stability for hydrofoil craft through the attachment of the struts in the hydrofoil craft and in the lifting wing or wings. This is carried out through a direct mechanical coupling between movement of the struts and some means, such as ailerons or rotation in opposite direction of port and starboard side of the lifting wing(s) around a transversal axis, that alter the spanwise distribution of pressure on the lifting wing or wings.

If the craft gets a disturbance in roll-angle, the resultant of the craft's gravity and hydrodynamic force on the lifting wing will act in the direction of the disturbance. This resulting side-force causes a transversal movement of the craft relative the water, which makes the struts move relative the hydrofoil craft. This movement actuates some of the means mentioned above, which modifies the spanwise distribution of pressure on the lifting wing or wings, so the craft rolls back to equilibrium.

Please note that all the embodiments or features of an embodiment could be combined in any way if such combination is not clearly contradictory.

The invention thus relates to a hydrofoil arrangement for a hydrofoil craft with at least one fully submerged lifting wing, the hydrofoil arrangement comprising at least two struts pivotally arranged on the hydrofoil craft, each strut being connected to a lifting wing, where the struts are arranged with their centres of effort of hydrodynamic forces behind the pivot axes of the struts during forward travel of the hydrofoil craft, whereby the struts are arranged to pivot relative to the hydrofoil craft when the hydrofoil craft experiences a disturbance in roll-angle, this resulting in a transversal movement of the hydrofoil craft relative to the water surface during forward travel, where the struts when pivoting are arranged to actuate through a direct mechanical coupling at least one means for inducing transversal displacement of the resulting lifting wing's centre of effort in the direction of the transversal movement of the hydrofoil craft in order to modify the transversal distribution of pressure on the at least one lifting wing, whereby the hydrofoil craft is arranged to roll back to equilibrium.

While specific embodiments of the invention have been illustrated and described herein, it is realized that numerous other embodiments may be envisaged and that numerous additional advantages, modifications and changes will readily occur to those skilled in the art without departing from the spirit and scope of the invention. Therefore, the invention in its broader aspects is not limited to the specific details, representative devices and illustrated examples shown and described herein. Accordingly, various modifications may be made without departing from the spirit or scope of the general inventive concept as defined by the appended claims and their equivalents. It is therefore to be understood that the appended claims are intended to cover all such modifications and changes as fall within a true spirit and scope of the invention. Numerous other embodiments may be envisaged without departing from the spirit and scope of the invention.

The invention claimed is:

1. Hydrofoil arrangement for a hydrofoil craft the hydrofoil arrangement comprising:

at least one lifting wing to be fully submerged;

at least two struts pivotally disposed on the hydrofoil craft, each strut of said at least two struts being connected to said at least one lifting wing, each said strut being disposed with a respective center of effort of hydrodynamic forces thereof behind a pivot axis of each said strut during forward travel of the hydrofoil craft through a water surface;

when the hydrofoil craft, during forward travel, experiences a disturbance in roll-angle resulting in a transverse movement out of equilibrium of the hydrofoil craft relative to the water surface, said at least two struts being constructed for pivoting relative to the hydrofoil craft, when pivoting, said at least two struts actuate at least one means for inducing transverse displacement of the a center of effort of said at least one lifting wing in a direction of the transverse movement of the hydrofoil craft, said at least two struts actuating said at least one means for inducing transverse displacement via a direct mechanical coupling for modifying a transverse distribution of pressure on said at least one lifting wing for rolling the hydrofoil craft back to equilibrium;

said direct mechanical coupling including a respective linking device disposed at each said strut, and said at least one means for inducing transverse displacement being ailerons disposed on said at least one lifting wing, and movements of said ailerons being mechanically coupled to rotations of each said strut by said respective linking devices.

2. The hydrofoil arrangement according to claim 1, wherein said centre of effort of hydrodynamic forces on each said strut is disposed further behind the pivot axes of said at least two struts than the centre of effort for hydrodynamic force on the at least one lifting wing as seen in the general forward travel direction of the hydrofoil craft.

3. The hydrofoil arrangement according to claim 1, wherein each said pivot axis is disposed on a support, which is disposed to be rotatable in relation to the hydrofoil craft.

4. The hydrofoil arrangement according to claim 3, wherein the support is disposed to be rotatable around a transverse axis relative to the hydrofoil craft.

5. A Hydrofoil arrangement for a hydrofoil craft the hydrofoil arrangement comprising:

at least one lifting wing to be fully submerged;

at least two struts pivotally disposed on the hydrofoil craft, each strut of said at least two struts being connected to said at least one lifting wing, each said strut being disposed with a respective center of effort of hydrodynamic forces thereof behind a pivot axis of each said strut during forward travel of the hydrofoil craft through a water surface;

when the hydrofoil craft, during forward travel, experiences a disturbance in roll-angle resulting in a transverse movement out of equilibrium of the hydrofoil craft relative to the water surface, said at least two struts being constructed for pivoting relative to the hydrofoil craft, when pivoting, said at least two struts actuate at least one means for inducing transverse displacement of a center of effort of said at least one lifting wing in a direction of the transverse movement of the hydrofoil craft, said at least two struts actuating said at least one means for inducing transverse displacement via a direct mechanical coupling for modifying a transverse distribution of pressure on said at least one lifting wing for rolling the hydrofoil craft back to equilibrium, said direct mechanical coupling including a linking device disposed for ensuring that vertical components of rotation of each said strut are in the same direction, and said direct mechanical coupling including said at least two struts, and said at least one means for inducing transverse displacement being said at least one lifting wing disposed for deflecting torsionally around a transverse axis between said at least two struts;

each said strut being pivotally connected to said at least one lifting wing about a respective lower strut pivot axis, said at least two struts being a port strut and a starboard strut, an angle $+\mu$ exists between said pivot axis and said lower pivot axis of said port strut, and a corresponding angle $-\mu$ exists between said pivot axis and said lower pivot axis of a starboard strut, as seen from the rear of the hydrofoil craft.

6. The hydrofoil arrangement according to claim 5, wherein said pivot axis of said port strut is inclined transversely upwards towards the centre of the hydrofoil craft and said pivot axis of said starboard strut is inclined transversely upwards towards the centre of the hydrofoil craft.

7. A Hydrofoil arrangement for a hydrofoil craft the hydrofoil arrangement comprising:

at least two struts pivotally disposed on the hydrofoil craft, each strut of said at least two struts being connected to a respective lifting wing disposed for being fully submerged, each said strut being disposed with a respective center of effort of hydrodynamic forces thereof behind a pivot axis of each said strut during forward travel of the hydrofoil craft through a water surface;

when the hydrofoil craft, during forward travel, experiences a disturbance in roll-angle resulting in a transverse movement out of equilibrium of the hydrofoil craft relative to the water surface, said at least two struts being constructed for pivoting relative to the hydrofoil craft, when pivoting, each said strut actuates a respective means for inducing transverse displacement of a center of effort of said respective lifting wing in a direction of the transverse movement of the hydrofoil craft, each said strut actuating said respective means for inducing transverse displacement via a direct mechanical coupling for modifying a transverse distribution of pressure on said lifting wings for rolling the hydrofoil craft back to equilibrium, said direct mechanical coupling including a linking device, disposed for ensuring that vertical components of the rotation of each said strut are in a same direction, and said direct mechanical coupling including said at least two struts, and said respective means for inducing transverse displacement being said respective lifting wings disposed for rotating together with said respective strut.

8. The hydrofoil arrangement according to claim 7, wherein said at least two struts are a port strut and a starboard strut, said pivot axis of said port strut extends transversely upwards towards a centre of the hydrofoil craft at an inclination with an angle $+\mu$ to a perpendicular of said respective lifting wing and said pivot axis of said starboard strut extends transversely upwards towards the centre of the hydrofoil craft at an inclination angle $-\mu$ to a perpendicular of said respective lifting wing.

* * * * *